US005094656A

United States Patent [19]

Hatchell et al.

[11] Patent Number: 5,094,656

[45] Date of Patent: Mar. 10, 1992

[54] SERVO DRIVE BAG MACHINE

[75] Inventors: Peter Hatchell; Charles A. Sample; Jeffrey Ross, all of Green Bay, Wis.

[73] Assignee: FMC Corporation, Chicago, Ill.

[21] Appl. No.: 269,820

[22] Filed: Nov. 10, 1988

[51] Int. Cl.[5] ..... B31B 19/00

[52] U.S. Cl. ..... 493/193; 493/29; 226/115

[58] Field of Search ..... 493/11, 29, 193, 194, 493/199, 203, 204; 156/515; 226/108, 115

[56] References Cited

U.S. PATENT DOCUMENTS

| | | | |
|---|---|---|---|
| 3,431,828 | 3/1969 | Crawford et al. | 493/254 |
| 3,722,376 | 3/1973 | Wech | 493/199 |
| 3,805,683 | 4/1974 | Hook | 493/194 |
| 3,822,168 | 7/1974 | Wech | 156/583.1 |
| 4,070,951 | 1/1978 | Bala | 493/24 |

OTHER PUBLICATIONS

"Bottom weld Bagmaking Machine", Alpine Plastic Machinery, 1982.

*Primary Examiner*—Frederick R. Schmidt
*Assistant Examiner*—Jack Lavinder
*Attorney, Agent, or Firm*—Douglas W. Rudy; Richard B. Megley

[57] ABSTRACT

A machine for the continuous production of plastic bags utilizes a servo drive motor to drive the machines film web draw roll assembly and through a seal roll index gear also to drive a seal roll of the machine in coordination with the servo driven draw roll.

3 Claims, 6 Drawing Sheets

FIG_3A
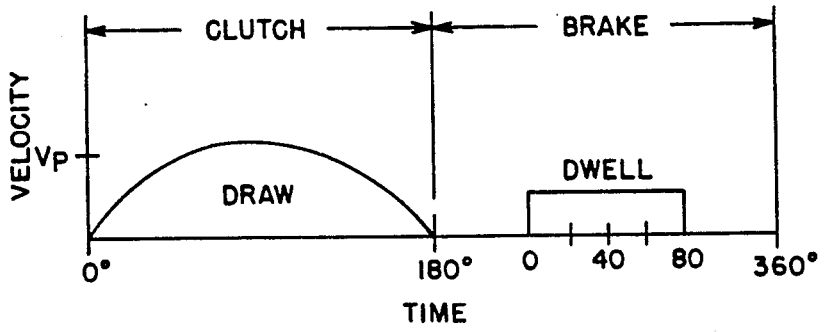
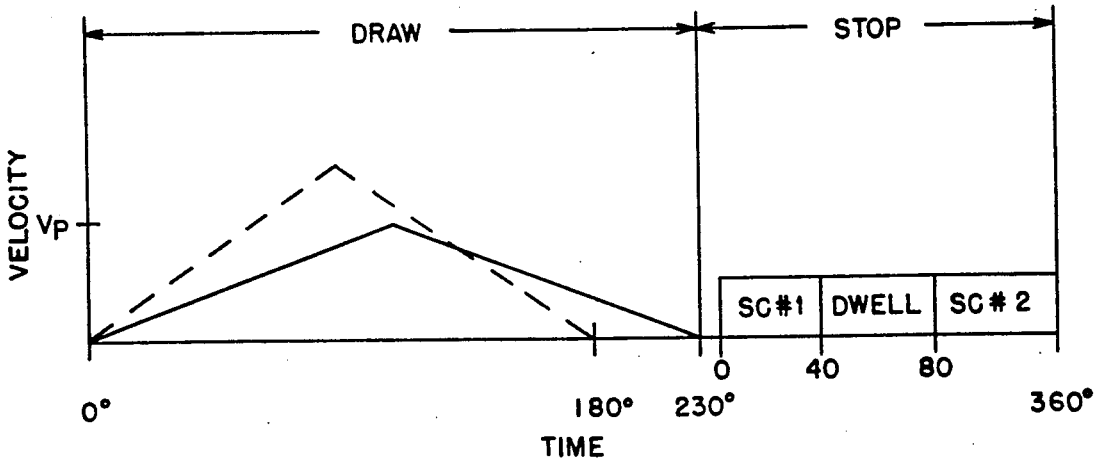
FIG_3B

SERVO DRIVE BAG MACHINE

BACKGROUND OF THE INVENTION

This invention has to do with the modification of well known bag making machines to increase the production capability of such well known bag machines. The "poly" bag making industry is a well developed industry with numerous bag machine styles competing for a share of the market. A typical bag making machine is the FMC Corporation's Model 175W bag making machine which is a bag machine that produces "side weld" poly bags and stacks the completed bags using a "wicketer", as is well known in the art.

The "175W" is equipped with a main drive electric motor that drives a main drive shaft. Moving elements such as draw rolls, seal head and the wicketer are driven by the main drive motor. The draw rolls, which pull a web of film from a supply of film, either a roll of film or a continuously extruded web of film, are driven by a gear and pulley system utilizing a crank and rocker linkage to a segment gear, which utilizes a well known conventional clutch/brake system to connect a reciprocating motion into a reversible one direction rotary motion. The motion produced by this "clutch/brake means" is a harmonic motion that, based on the various gear ratios, will yield a maximum film web acceleration as the film web is drawn through the draw rolls, for any given number of machine cycles, as determined by a single rotation of the main drive shaft. This will be discussed further on in this Specification.

It is desirable to increase bag machine production; however, the aforesaid peak film acceleration has been a limiting factor.

The invention presented herein is an advantage over current production bag machines in that the peak film acceleration for any given machine speed (cycles per minute) has been reduced. This permits the machine to operate at a higher speed, and produce more bags per minute, without exceeding the maximum velocity tolerated by the web. Thus allowing faster machine cycles at the same peak film acceleration.

The advantage of this technology also directly applies to existing "conventionally" driven bag machines similar to the Model 175W mentioned above. Using the invention disclosed herein it is apparent that the technology can be directly applied to the conventional machines, with some serious machine modifications, to enable the prior existing machines to increase their levels of production to those accomplishable by a current production servo draw roll and seal roll drive machine.

BRIEF DESCRIPTION OF THE DRAWING FIGURES

The invention herein will be easily understood when the Specification is read in conjunction with the accompanying drawing figures wherein:

FIG. 3A is a chart showing one machine cycle of a prior art machine;

FIG. 3B is a chart showing one machine cycle of the instant invention machine;

DETAILED DESCRIPTION OF THE INVENTION

Figure 1:
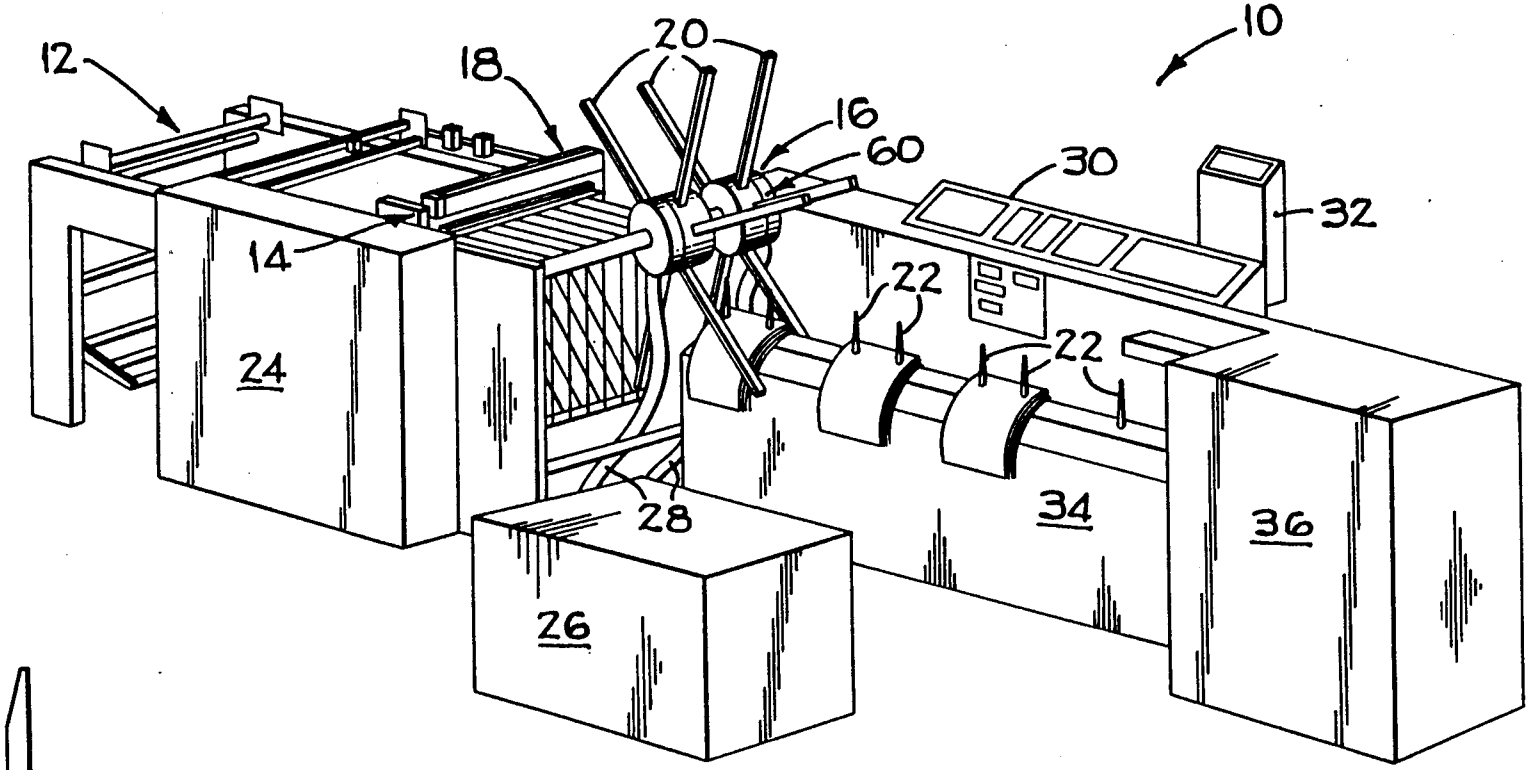
FIG. 1 is a pictorial representation of a bag making machine embodying the invention.

The FIG. 1 shows the general environment of the invention in that a bag making machine of a recognizable general configuration is presented. The bag making machine, generally 10 is made up of a plurality of distinct sections including a tension control and anti-bounce section generally 12, a bag forming section, generally 14 and a wicket stacking section generally 16. A web of film is threaded through the tension control section 12. The web generally originates from a roll of film that has been rolled from a tube of blown/extruded poly material at a remote location in a well known manner. The web is drawn into the bag forming section 14 by a pair of draw rolls that generally includes an upper and lower draw roll providing a nip that grips the web to urge it to a cutting and sealing head 18 while also drawing the film off its storage roll and through the tension control section. After the web has been cut to a desired bag width by the cutting and sealing head 18, which provide the edges defining the width of the bag, the individual bags will be picked up by vacuum arms such as 20 and deposited on pins such as 22 in a conventional manner.

The main drive motor 158 (FIG. 2) for the bag maker, as well as other indexing hardware, is contained in enclosure 24 and in the area under the bag forming section. Enclosure 26 houses vacumm elements from which vacuum is supplied to the vacuum arms 20 by hoses such as 28.

An operator's control panel 30 includes an operator input interface 32. Cabinet 34 houses the pin stack bag accummulating take away conveyor 36.

Figure 2:
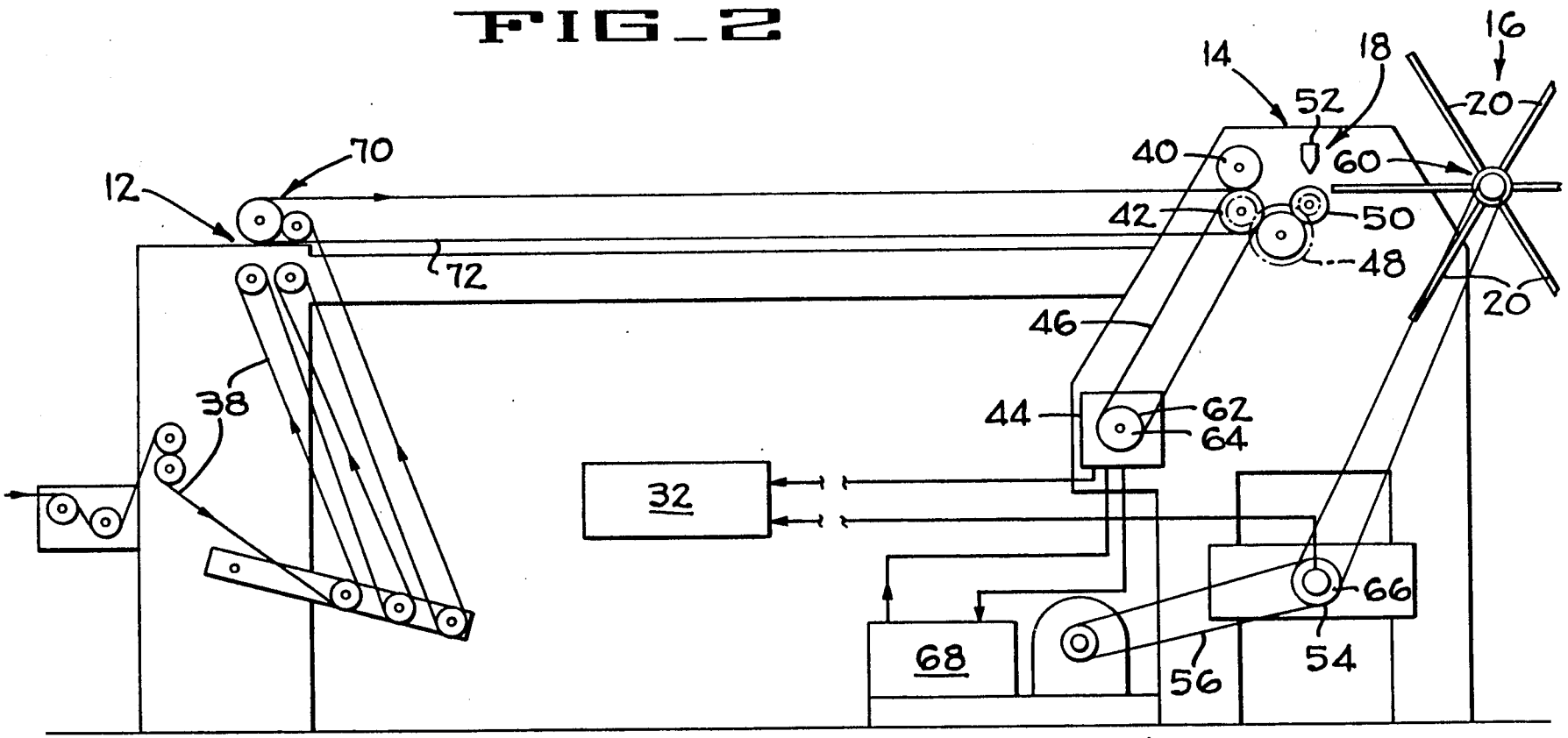
FIG. 2 is a simplistic diagrammatic presentation of the invention utilizing a seal roll index gear.

FIG. 2 pictorially presents the invention. In this figure a web of film 38 is shown threaded through the tension control and anti bounce section generally 12 to the bag forming section generally 14. On the bag forming section an upper draw roll 40 and a lower draw roll 42 have the film web held in the nip formed between these draw rolls. The lower draw roll 42 is driven by a servo motor 44 through a belt or chain 46. The lower draw roll means 42 also includes a geared portion that is in engagement with a seal roll index gear means 48 which is in engagement with a seal roll means 50. Thus, the seal roll means 50 and the lower draw roll means 42 are both drivable and driven by the servo motor 44. A seal bar 52 is conventionally cycled vertically by drive linkage means (not shown) from a cam associated with the main drive shaft 54. The main drive shaft 54 will rotate once per machine cycle which is equivalent to once per bag development on a single lone bag machine.

Figure 4:
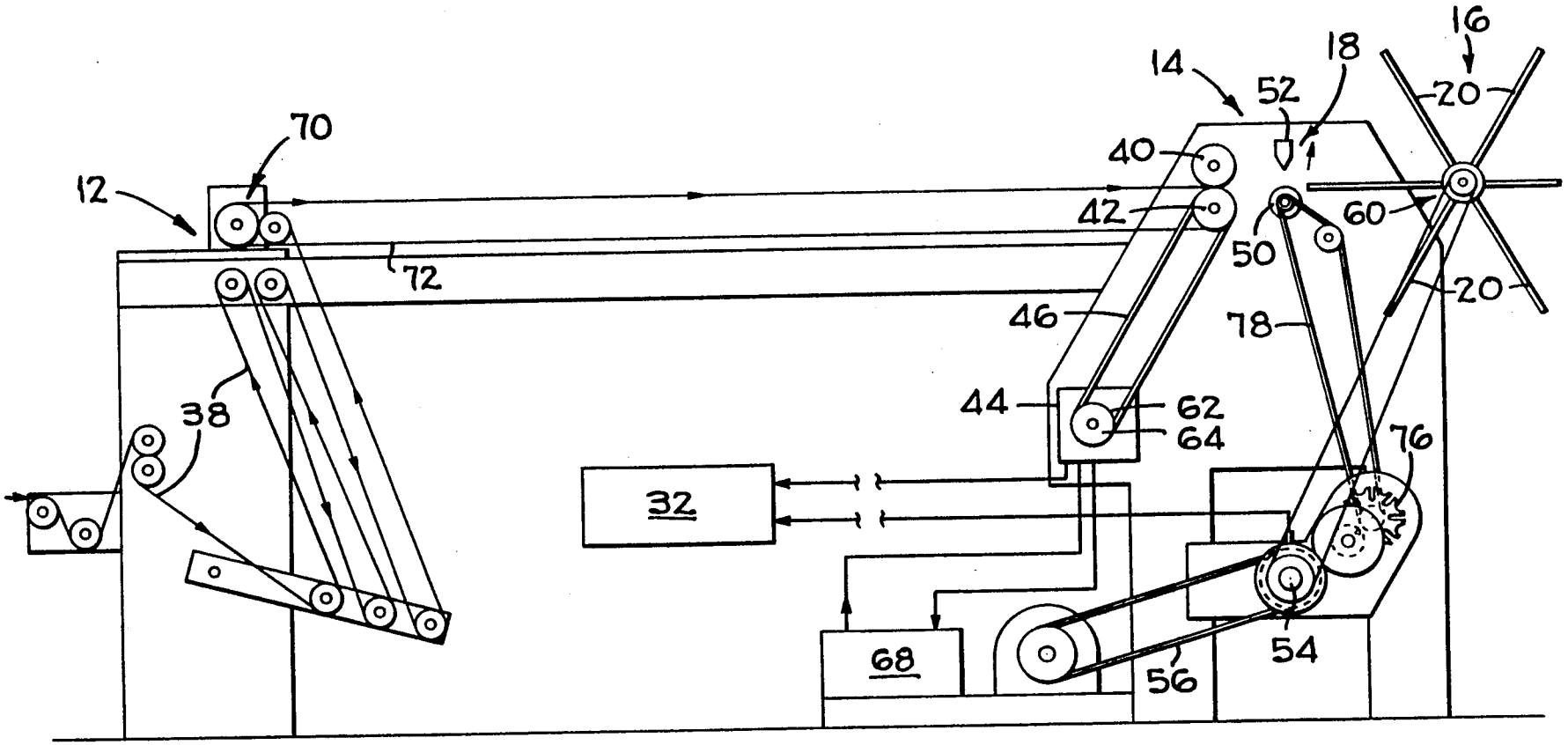
FIG. 4 is a simplistic diagrammatic presentation of the invention utilizing a geneva gear means to drive the seal roll.

The vacuum arm assembly 60, which includes machine arms 20, is indirectly driven off the main shaft 54 at some ratio, typically 6:1 in the pictorial FIGS. 2 and 4.

Control elements of the servo motor 44 are provided by a tachometer 62 and a feed back shaft encoder 64 mounted on the servo motor, a master shaft encoder 66 on the main drive shaft 54 and a servo amplifier 68, and on operator input device or controller 32. These elements are electrically linked together via various electrical conduits which will be more fully explained when considering FIG. 7.

Also shown in FIG. 2 is an anti-bounce means 70 which is simplistically shown. The anti-bounce means 70 is driven by means of a belt 72 which drives the anti-bounce means from the lower draw roll means 42 which, as pointed out, is driven by the servo motor.

FIGS. 3A and 3B are charts that have been prepared to show the advance that this invention provides over a conventionally driven, that is non servo driven, bag machine. FIG. 3A presents a graph of the prior art, for instance the applicant's assignee Model 175 bag machine. This is a machine that utilized a clutch/brake means between the main drive and the draw rolls to advance the film web through the bag forming station. The vertical axis of the chart shows web velocity while the horizontal axis is time as expressed in degrees of draw roll rotation. "Vp" on the velocity scale represents peak web velocity that can be generated by the harmonic bag development cycle using the eccentric crank slide linkage and the clutch/brake means of prior art equipment. The web draw length is limited to 180° of main drive shaft rotation (50% of the machine cycle), and the machine cycle speed is limited by web acceleration, the peak velocity Vp at the peak of the curve from 0° tp 180°, and also by web or film leading edge stability at a given web velocity. In the "BRAKE" portion of this chart, from 180° to 360°, the sealing of the developed web is accommplished during the dwell portion of the braked status of the lower draw roll.

FIG. 3B is a graph showing bag development when the main drive driven clutch/brake mechanism has been replaced with a servo motor controlled lower draw roll and seal roll means. Because the servo motor 44 is independently controllable, the period for advancing the film web need not be limited to no more than 50% of each machine cycle, In this chart the axis are the same, however, it can be seen that there is more time, i.e., 230° instead of 180° to developed the bag. This is due to the constant acceleration of the development provided by the servo motor drive. In this chart the draw length is optimized to use virtually all time available in the draw cycle not used for the dwell necessary during the bag sealing operation and a seal clearance time, shown as SC#1 and SC#2, before and after the dwell time when the seal bar is engaged to seal the bag against the platen provided by the seal roll.

The "slope of the velocity lines" of the FIG. 3B chart shows that web acceleration is significantly less than that shown if the bag was developed in only 180° of draw as shown and represented by the broken line curve starting at 0° and ending at 180°. Since one limiting factor on bag development can be the peak acceleration experienced by the web during draw, it follows that if the peak velocity is decreased by use of the servo driven draw rolls in place of the clutch/brake draw roll actuation means it is possible to increase bag production by increasing the speed of the servo draw roll driven gab machine until the peak acceleration of the servo driven draw roll machines matches the peak acceleration of the conventional clutch/brake machine.

For example, and referring further to FIGS. 3A and 3B, a prior art machine, which can only advance the web over no more than 50% of each machine cycle, (180° of main drive shaft rotation), has a maximum machine cycle rate of 200 cycles (bags) per minute assuming a 9 inch bag width and assuming the web is unable to withstand accelerations greater than 1712 inches/sec$^2$, a typical limitation on web acceleration. A machine capable of advancing the web over more than 50% of each machine cycle, however, can operate at a faster rate, and develop more of the same size bags, without subjecting the web to an acceleration higher than the 1712 inch/sec$^2$ limit. If, for example, the web can be advanced over 230° of the main drive shaft rotation rather than 180°, the machine can now operate at 264 cycles per minute without exceeding the maximum tolerable web acceleration, thereby giving a net increase of 64 bags per minute.

Figure 6:
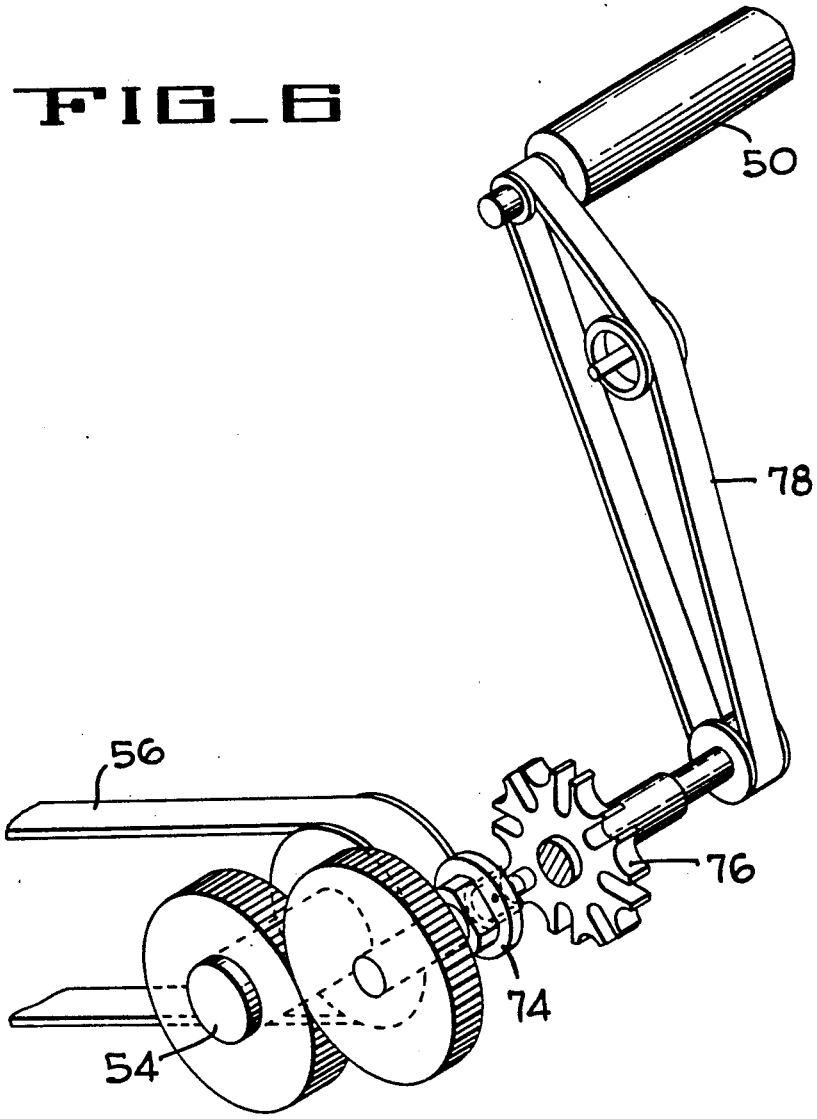
FIG. 6 is a partially broken away section of a geneva gear means.

FIG. 4 presents an alternative embodiment to the FIG. 2 embodiment that utilized a seal roll index gear means between the lower draw roll 42 and the seal roll 50. In the FIG. 4 embodiment, wherein like elements have been assigned like reference characters, the seal roll index gear means has been replaced with a well known geneva drive mechanism that drives the seal roll from the main drive shaft 54. FIG. 6 shows the geneva drive assembly in more detail. This drive assembly operates as an eight step escapement device which receives input from the main drive through belt 56 where drives a gear driven eccentric pin 74 engaged with the geneva escapement gear 76. A belt 78 drives the seal roll 50 in a well known manner. One advantage of the geneva drive over the seal roll index gear means is that there is less inertia in the gear train for the servo motor drive 42 to overcome, therefore, reducing load on the servo motor and its connection to the lower draw roll. The geneva system also allows a separately phaseable indexing of the seal roll.

Figure 5A:
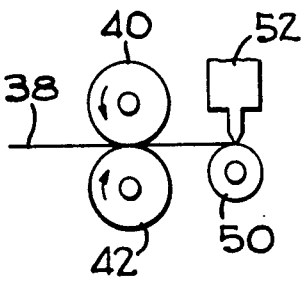
FIG. 5A, 5B and 5C are diagrammatic presentations of draw rolls during a "cycle interrupt" cycle.
Figure 5B:
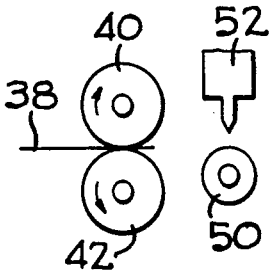
Figure 5C:
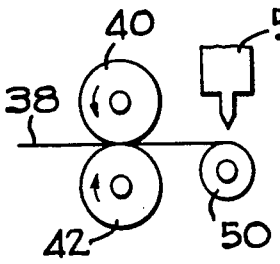

FIGS. 5A, 5B, and 5C, in a very simplistic schematic, show that the lower draw roll will be indexed in reverse (5B) to pull the web of film 38 off the seal roll 50 by the servo drive means. This will be done during cycle interrupt when a given number of bags, for instance 250 bags, have been cycled through the machine and stacked on the wicket pins 22 so that an emply set of pins can be indexed into place for the next stack of bags.

In addition to the limitations on bag development due to acceleration of the film web by the draw rolls it has been found that a further limitation can exist when removing and stacking bags using the wicket pin and vacuum arm method of stacking bags. That is clearance between the vacuum arms and a newly developed bag. Once a vacuum arm 20 (FIG. 20) has picked up a bag, the arm must be clear of the leading edge of the next bag. Vacuum arms 20, aka known as wicket arms, have a typical thickness of about one inch at their outboard end. The end of the arm is approximately one inch away from the seal roll 50 on conventional machines and is approximately 20 inches long. In order to clear the next bag the wicket arm 20 must move approximately 3° to give one inch (the thickness of the vacuum arm) of clearance. With six arm sets, the arms are driven at a 6:1 ratio and thus require 18° of machine cycle for clearance to clear the arm from the leading edge of the next bag.

A method of ensuring that bags are not developed into the vacuum arms is provided by using the servo drive draw roll controls to ensure that the draw time is gradually increased as the main drive increases in speed. The main drive cannot get up to maximum set speed as fast as the draw section so the draw section is only gradually increased to not exceed the machine speed. This primarily is to prevent developing bags into the vacuum arms. The servo draw cycle is configured in machine degrees via the master encoder 66 only and not in real time. The draw roll speed is matched to the main drive speed through the master encoder and the feed back controller 64 operating the servo motor under the control of the motion controller. Thus, upon machine start up the draw starts out slowly and matches the main drive speed until the main drive gets up to speed. The draw speed will follow the main drive speed up rather than get ahead of it.

Figure 1A:
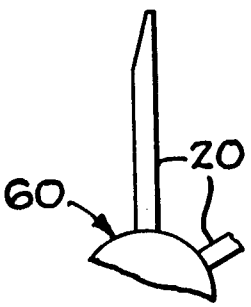
FIG. 1A is a detail of one vacuum arm showing an alternative embodiment having a truncated end.

An improvement in the wicket arms is shown in FIG. 1A wherein a beveled end is formed on the outboard end of the wicket or vacuum arm 20. By beveling the end of the arm, the effective thickness of the arm is reduced allowing the necessary degrees of clearance to be lessened. In the example above, the 3% of our travel necessary to give one inch of clearance can be reduced by making the end of the arm less than one inch in thickness. This also allows faster bag development times as the wicket arms "get out of the way" of the new bag edge more quickly.

Figure 7:
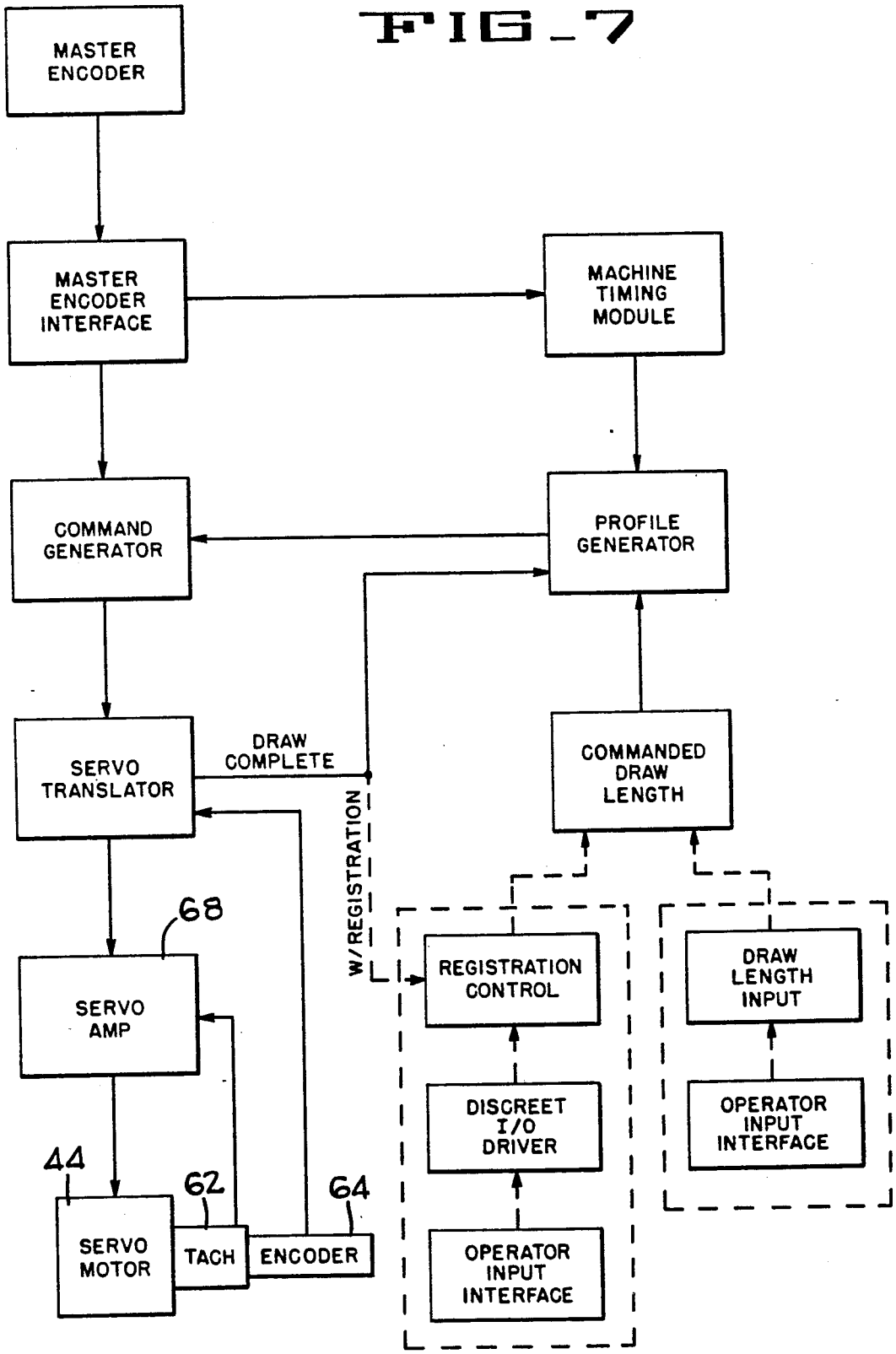
FIG. 7 is a chart showing the electrical interrelationships among various control components and elements of the invention.

FIG. 7 presents a flow chart of the relationship between the control elements of the servo drive draw roll machine. The master encoder is the master shaft encoder 66 which picks up a zero marker on the main drive shaft. The encoder signal is directed to the master encoder interface which processes the signal to the machine timing module which sets the amount of time in machine degrees available for the profile generator.

The generated profile is sent to the command generator which through the servo translator directs the servo amp to energize the servo motor to drive the lower draw roll. The servo motor tachometer feeds back the servo motor speed to the servo amp while the feed back encoder 64 loops back to the servo translator which will, upon reaching the desired degrees of draw, signal the profile generator that the draw is complete. (The master encoder interface, machine timing module, command generator and profile generator all reside in the motion controller 32.

The elements contained in the broken line boxes are alternative embodiments for arriving at commanded draw length. The left box is for use when the film being made into bags is preprinted and is thus print registered. The registration control will determine draw length after checking print markers on the film. The right box is an operator controlled draw length selection where the operator will input a desired bag draw length.

What has been disclosed herein is an improved bag making machine that uses a servo driven draw roll drive to replace main drive driven draw roll drives well known in the art. Nuances of the invention that are obvious to those having skill in the art of bag making machine design are contemplated as being covered by the following claims in which:

What is claimed is:

1. A method of modifying the structure of a bag machine having a rotatable main drive shaft for defining successive machine cycles, a draw roll for drawing a plastic film web from a supply, clutch/brake means driven by the main drive shaft for indexing the draw roll, a seal roll operable during a web seal period and a seal roll index gear, said method comprising the steps of:

replacing said clutch/brake means of said bag machine with a servo motor;

installing a master encoder for indicating the rotational position of the main drive shaft;

installing electronic control means responsive to said master encoder and operable to control operation of said servo motor in accordance with the rotational position of the main drive shaft; and adjusting said control mean stop operate said servo motor so that the speed of said servo motor is related to the rotational position of said main drive shaft and so that the web is advanced by a predetermined distance over each machine cycle regardless of the actual duration of each machine cycle and so that the web is advanced at a substantially constant positive acceleration during substantially half the portion of each machine cycle between said web seal period and is advanced at a substantially constant negative acceleration over the remaining portion of each machine cycle between said web seal period.

2. A method as defined in claim 1 wherein the bag machine further includes a bag wicketer operatively driven by the main drive haft and wherein said method includes the further step of adjusting said control means to operate said servo motor so as to advance the web and thereby develop side seal bags at a rate no faster than the rate the bag wicketer can wicket the side seal bags developed by the bag machine.

3. A method as defined in claim 1 wherein the web is sealed during a seal cycle comprising a seal clearance period immediately preceeding and immediately following a sealing operation, and wherein said method comprises the further step of adjusting said control means to operate said servo motor so that the web is advanced over substantially the entire portion of each machine cycle not devoted to said seal cycle.

* * * * *